US011097861B1

(12) United States Patent
Donati

(10) Patent No.: US 11,097,861 B1
(45) Date of Patent: Aug. 24, 2021

(54) PACKAGING MACHINE AND METHOD FOR PRODUCING SEALED PACKAGES

(71) Applicant: Tetra Laval Holdings & Finance S.A., Pully (CH)

(72) Inventor: Andrea Donati, Castelnuovo Rangone (IT)

(73) Assignee: Tetra Laval Holdngs & Finance S.A., Pully (CH)

( * ) Notice: Subject to any disclaimer, the term of this patent is extended or adjusted under 35 U.S.C. 154(b) by 0 days.

(21) Appl. No.: 15/733,825

(22) PCT Filed: May 28, 2019

(86) PCT No.: PCT/EP2019/063833
§ 371 (c)(1),
(2) Date: Nov. 30, 2020

(87) PCT Pub. No.: WO2019/229069
PCT Pub. Date: Dec. 5, 2019

(30) Foreign Application Priority Data

Jun. 1, 2018 (EP) ..... 18175448

(51) Int. Cl.
*B65B 9/207* (2012.01)
*B65B 9/20* (2012.01)
(Continued)

(52) U.S. Cl.
CPC ..... *B65B 9/207* (2013.01); *B65B 9/12* (2013.01); *B65B 9/2028* (2013.01);
(Continued)

(58) Field of Classification Search
CPC ..... B65B 9/12; B65B 6/2014; B65B 9/2028; B65B 9/2049; B65B 9/207; B65B 9/213;
(Continued)

(56) References Cited

U.S. PATENT DOCUMENTS 5,044,140 A * 9/1991 Iwano et al. ..... B65B 55/103 53/167
6,438,929 B2 * 8/2002 Kume et al. ..... B65B 9/213 53/493

(Continued)

FOREIGN PATENT DOCUMENTS

| | | |
|---|---|---|
| EP | 1334911 | 8/2003 |
| EP | 1790572 | 5/2007 |
| EP | 2695816 | 2/2014 |

OTHER PUBLICATIONS

Communication Under Rule 71(3) in European Application 19177036.1, dated Sep. 11, 2020, in 6 pages.

(Continued)

*Primary Examiner* — Stephen F. Gerrity
(74) *Attorney, Agent, or Firm* — Knobbe, Martens, Olson & Bear, LLP

(57) ABSTRACT

There is described a packaging machine for producing sealed packages of a pourable product from a web of packaging material, which may include conveying means for advancing the web of packaging material along a web advancement path at least to a tube forming station at which the web of packaging material is formed into a tube and for advancing the tube along a tube advancement path, an isolation housing having a main chamber and an auxiliary chamber arranged downstream of the main chamber along the tube advancement path, a tube forming and sealing device at least partially arranged within the main chamber and being configured to form and longitudinally seal the tube within the main chamber, a filling device for filling the tube with the pourable product and a pressure control device configured to control a first pressure within the main chamber and a second pressure within the auxiliary chamber such that the first pressure is higher than the second pressure and (Continued)

the first pressure and the second pressure are both higher than the ambient pressure.

15 Claims, 5 Drawing Sheets

(51) Int. Cl.

| | |
|---|---|
| ***B65B 55/10*** | (2006.01) |
| ***B65B 31/02*** | (2006.01) |
| ***B65B 31/04*** | (2006.01) |
| ***B65B 51/26*** | (2006.01) |
| ***B65B 9/12*** | (2006.01) |

(52) U.S. Cl.
CPC ..... *B65B 9/2049* (2013.01); *B65B 31/024* (2013.01); *B65B 31/045* (2013.01); *B65B 51/26* (2013.01); *B65B 55/103* (2013.01)

(58) Field of Classification Search
CPC ... B65B 31/021; B65B 31/024; B65B 31/045; B65B 51/26; B65B 51/306; B65B 55/025; B65B 55/08; B65B 55/103
USPC ..... 53/167, 426, 451, 551
See application file for complete search history.

(56) References Cited

U.S. PATENT DOCUMENTS 7,093,405 B2 * 8/2006 Andersson et al. .. B65B 55/103 53/167
2006/0145093 A1 * 7/2006 Naslund et al. ..... B65B 55/08 250/492.1

OTHER PUBLICATIONS

International Preliminary Report on Patentability of PCT/EP2019/063833, dated May 28, 2019, in 7 pages.
International Search Report and Written Opinion of PCT/EP2019/063833, dated Aug. 19, 2019, in 8 pages.

* cited by examiner

PACKAGING MACHINE AND METHOD FOR PRODUCING SEALED PACKAGES

TECHNICAL FIELD

The present invention relates to a packaging machine for producing sealed packages of a pourable product, in particular a pourable food product.

The present invention also relates to a method for producing sealed packages of a pourable product, in particular a pourable food product.

BACKGROUND ART

As is known, many liquid or pourable food products, such as fruit juice, UHT (ultra-high-temperature treated) milk, wine, tomato sauce, etc., are sold in packages made of sterilized packaging material.

A typical example is the parallelepiped-shaped package for liquid or pourable food products known as Tetra Brik Aseptic (registered trademark), which is made by sealing and folding laminated strip packaging material. The packaging material has a multilayer structure comprising a base layer, e.g. of paper, covered on both sides with layers of heat-seal plastic material, e.g. polyethylene. In the case of aseptic packages for long-storage products, such as UHT milk, the packaging material also comprises a layer of oxygen-barrier material (an oxygen-barrier layer), e.g. an aluminum foil, which is superimposed on a layer of heat-seal plastic material, and is in turn covered with another layer of heat-seal plastic material forming the inner face of the package eventually contacting the food product.

Packages of this sort are normally produced on fully automatic packaging machines, which advance a web of packaging material from a magazine unit through a sterilization apparatus for sterilizing the web of packaging material and into an isolation housing (a closed and at least in part sterile environment) in which the sterilized web of packaging material is maintained and advanced. During advancement of the web of packaging material through a main chamber of the isolation housing, the web of packaging material is folded and sealed longitudinally to form a tube having a longitudinal seal, which is further fed along a vertical advancing direction into and through an auxiliary chamber of the isolation housing.

In order to complete the forming operations, the tube is filled with a sterilized or sterile-processed pourable product, in particular a pourable food product, and is subsequently formed for at least partially defining the final shape of the package, transversally sealed and subsequently cut along equally spaced transversal cross sections within a package forming unit of the packaging machine during advancement along the vertical advancing direction.

Pillow packages are so obtained within the packaging machine, each pillow package having a longitudinal sealing band, a top transversal sealing band and a bottom transversal sealing band.

A drawback of the known packaging machines resides in that shortly after the sealing the longitudinal seal of the tube is still warm and, thus, is weaker than the fully cooled one. This is typically the case with the tube advancing within a downstream portion of the main chamber and an upstream portion of the auxiliary chamber. Therefore, it is required to control the overall process such to avoid or to at least limit the possibility of the longitudinal seal collapsing (i.e. to open and/or to lose integrity) during the advancement of the tube as a result of the forces acting on the tube itself.

Thus, the need is felt in the sector to provide packaging machines, which come along with a reduced risk of the longitudinal seal collapsing during operation of the packaging machines.

The need is also felt to provide for packaging machines, which allow to be operated at increased processing speeds (increased number of packages per hour, which can be produced).

DISCLOSURE OF INVENTION

It is therefore an object of the present invention to provide a packaging machine to overcome, in a straightforward manner, at least one of the aforementioned drawbacks.

In particular, it is an object of the present invention to provide a packaging machine allowing for reducing the risks that the longitudinal seal of the formed tube may collapse.

It is a further object of the present invention to provide a method for producing sealed packages to overcome, in a straightforward manner, at least one of the aforementioned drawbacks.

According to the present invention, there is provided a packaging machine and a method for producing sealed packages according to the independent claims.

Preferred embodiments are claimed in the dependent claims.

BRIEF DESCRIPTION OF THE DRAWINGS

A non-limiting embodiment of the present invention will be described by way of example with reference to the accompanying drawings, in which.

BEST MODES FOR CARRYING OUT THE INVENTION

Figure 1:
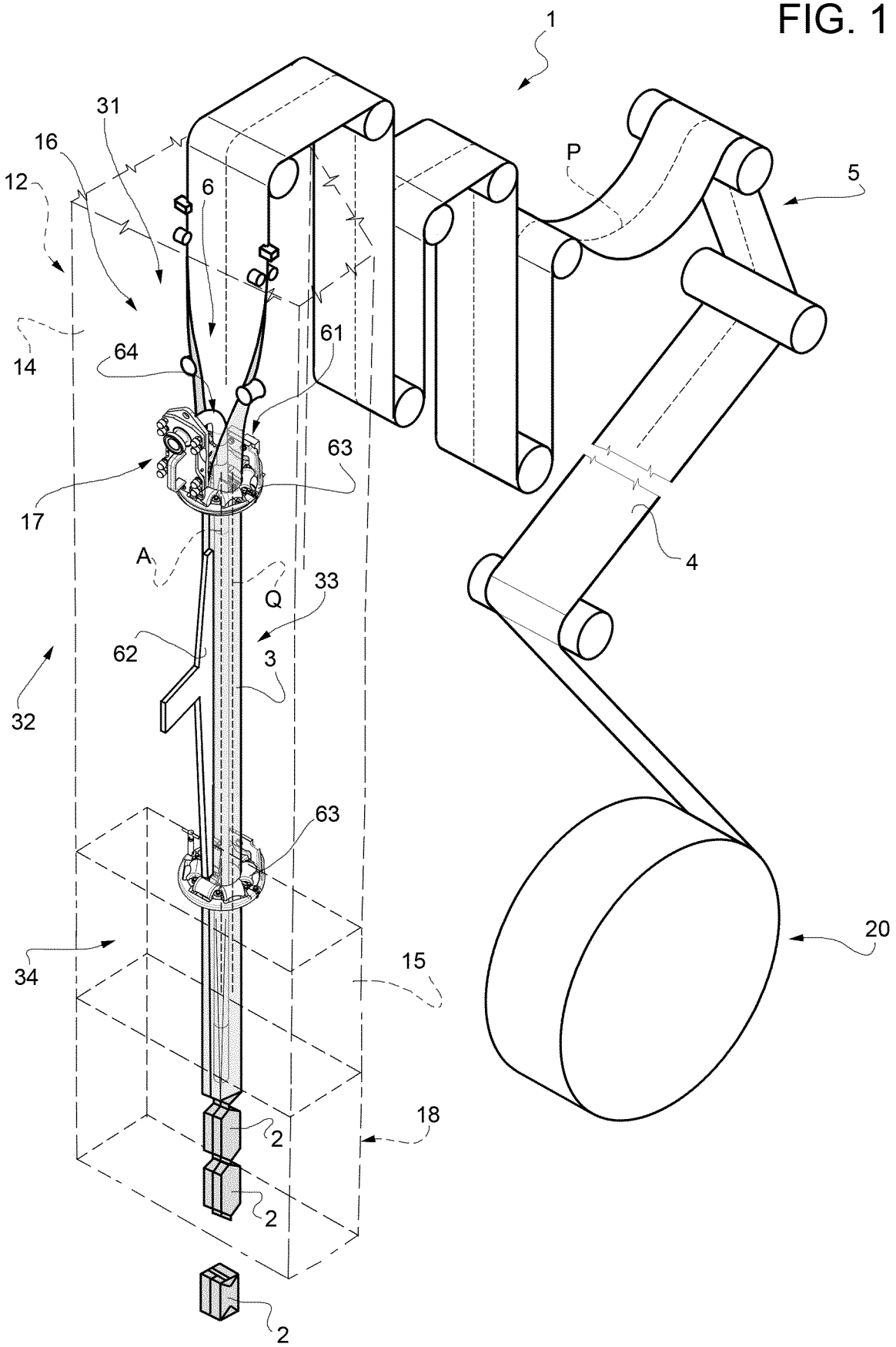
FIG. 1 is a schematic view of a packaging machine according to the present invention, with parts removed for clarity.

Number 1 indicates as a whole a packaging machine for producing sealed packages 2 of a pourable product, in particular a pourable food product such as pasteurized milk, fruit juice, wine, tomato sauce, etc., from a tube 3 of a web 4 of packaging material. In particular, in use, tube 3 extends along a longitudinal axis, in particular having a vertical orientation.

Web 4 comprises at least a layer of fibrous material, in particular paper, covered on both sides with respective layers of heat-seal plastic material, e.g. polyethylene.

In a non-limiting embodiment, web 4 also comprises a layer of gas- and light-barrier material, e.g. aluminum foil or ethylene vinyl alcohol (EVOH) film, and at least a first layer and a second layer of heat-seal plastic material. The layer of gas- and light-barrier material is superimposed on the first layer of heat-seal plastic material, and is in turn covered with the second layer of heat-seal plastic material. The second layer of heat-seal plastic material forms the inner face of package 2 eventually contacting the filled pourable food product.

More specifically, web 4 comprises a first face and a second face, in particular the first face being the face of web 4 forming the inner face of the formed package 2 eventually contacting the filled pourable food product.

A typical package 2 obtained by packaging machine 1 comprises a longitudinal seam portion and a pair of transversal sealing bands, in particular a transversal top sealing band and a transversal bottom sealing band.

With particular reference to FIG. 1, packaging machine 1 is configured to advance web 4 along a web advancement path P, preferably to sterilize web 4 during advancement along path P, to form tube 3 from web 4 and to fill tube 3 and, preferentially to form single packages 2 from the filled tube 3.

Preferentially, packaging machine 1 comprises:

conveying means 5 configured to advance web 4 along a web advancement path P at least to a tube forming station 6 at which web 4 is formed, in use, into tube 3 and for advancing tube 3 along a tube advancement path Q;

preferentially, a sterilization apparatus 7 for sterilizing at least a portion of web 4, preferentially at least the first face, even more preferentially the first face and the second face, at a sterilization station 8 arranged upstream of tube forming station 6 along web advancement path P;

an isolation housing 12 extending along a longitudinal axis A, in particular having a vertical orientation, and having at least a main chamber 14 and an auxiliary chamber 15, the latter being arranged downstream of main chamber 14 along tube advancement path Q;

a tube forming and sealing device 16 at least partially arranged within isolation housing 12, in particular main chamber 14, and being configured to form and longitudinally seal tube 3 at tube forming station 6 within at least a portion of isolation housing 12, in particular main chamber 14; and a filling device 17 for filling tube 3 with the pourable product.

Preferentially, packaging machine 1 also comprises a package forming unit 18 adapted to at least form and transversally seal tube 3, preferentially to also transversally cut tube 3, between successive packages 2, in particular during advancement of tube 3 along tube advancement path Q.

In a preferred non-limiting embodiment, packaging machine 1 also comprises a magazine unit adapted to host and to provide for web 4 at a host station 20.

Advantageously, packaging machine 1 also comprises a pressure control device 25 adapted to (configured to) control the pressure within at least portions of isolation housing 12, in particular within at least main chamber 14 and, preferentially also within auxiliary chamber 15.

In more detail, sterilization station 8 is arranged upstream of tube forming station 6 along web advancement path P. In other words, sterilization apparatus 7 is arranged upstream of isolation housing 12 along path P.

Preferentially, sterilization apparatus 7 is arranged downstream of the magazine unit along path P.

In particular, package forming unit 18 is arranged downstream of isolation housing 12 and tube forming and sealing device 16 along path Q.

In more detail, conveying means 5 are adapted to advance tube 3 and any intermediate of tube 3 in a manner known as such along path Q, in particular from tube forming station 6 through a portion of main chamber 14 and to and through auxiliary chamber 15, even more particular also towards and at least partially through package forming unit 18.

In particular, with intermediates of tube 3 any configuration of web 4 is meant prior to obtaining the tube structure and after folding of web 4 by tube forming and sealing device 16 has started. In other words, the intermediates of tube 3 are a result of the gradual folding of web 4 so as to obtain tube 3, in particular by overlapping opposite lateral edges of web 4 with one another.

Figure 2:
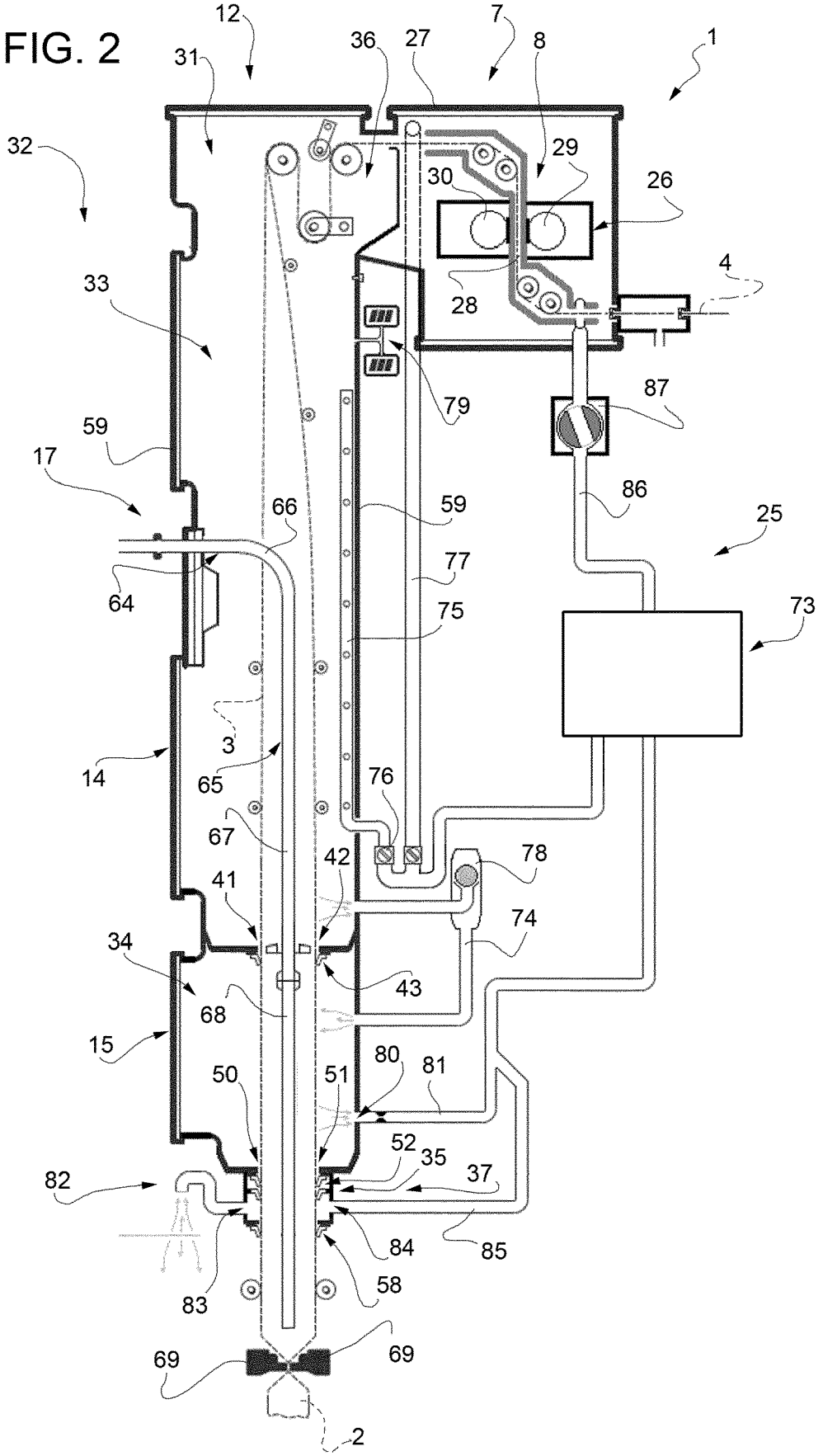
FIG. 2 is a schematic view of portions of the packaging machine of FIG. 1, with parts removed for clarity.

With particular reference to FIG. 2, sterilization apparatus 7 is configured to sterilize web 4, in particular the first face, even more particular also the second face, by means of physical sterilization such as by means of a sterilization irradiation, in particular an electromagnetic irradiation, even more particular by electron beam irradiation.

Alternatively, sterilization apparatus 7 could be configured to sterilize web 4, in particular the first face, even more particular also the second face, by means of chemical sterilization, in particular by means of hydrogen peroxide.

In more detail, according to the specific non-limiting example embodiment disclosed, sterilization apparatus 7 comprises an irradiation device 26 arranged in the area of sterilization station 8 and being adapted to sterilize at least the first face, preferentially also the second face, by directing a sterilizing irradiation, in particular electromagnetic irradiation, even more particular electron beam irradiation, onto at least the first face, preferentially also onto the second face, while, in use, web 4 advances along a sterilization portion of path P; and at least one shielding chamber 27 housing irradiation device 26 and, in particular comprising an advancement channel 28 through which, in use, web 4 advances, in use, during the sterilization of web 4, in particular the first face, even more particular also the second face.

More specifically, irradiation device 26 comprises:

at least a first irradiation emitter, in particular a first electron beam emitter 29, configured to direct the sterilizing irradiation, in particular the electromagnetic irradiation, even more particular the electron beam irradiation, in use, on the first face; and preferentially also a second irradiation emitter, in particular a second electron beam emitter 30, configured to direct the sterilizing irradiation, in particular the electromagnetic irradiation, even more particular the electron beam irradiation, in use, on the second face.

Preferably, electron beam emitter 29 and electron beam emitter 30 are arranged side-by-side and distanced from one another so that at least a portion of advancement channel 28 is interposed between electron beam emitter 29 and electron beam emitter 30.

With particular reference to FIGS. 1 and 2, isolation housing 12 is configured to separate an inner environment 31, in particular having at least one sterile portion, from an outer environment 32.

In more detail, main chamber 14 is the portion of isolation housing 12 in which web 4 is, in use, formed into tube 3 and in which web 4 is, in use, longitudinally sealed. In other words, main chamber 14 contains the portions of tube forming and sealing device 16, which directly interact with web 4 and tube 3 itself for forming and longitudinally sealing tube 3.

In further detail, auxiliary chamber 15 is arranged (directly) downstream of main chamber 14 along tube advancement path Q. In use, tube 3 advances through auxiliary chamber 15 after its formation and after its longitudinal sealing. In particular, in use, the formed and longitudinally sealed tube 3 advances directly from main chamber 14 into auxiliary chamber 15 (i.e. there is no further chamber arranged between main chamber 14 and auxiliary chamber).

In particular, main chamber 14 and auxiliary chamber 15 are connected, even more particular directly connected, to one another.

Preferentially, main chamber 14 comprises a respective main inner space 33 defining a portion of inner environment 31, in particular a sterile portion of inner environment 31. In other words, main chamber 14 is preferentially an aseptic main chamber 14.

In even other words, in use, web 4 advances through a portion of main chamber 14 prior to being formed into tube 3. As preferentially inner space 31 is sterile, sterility of web 4 and of tube 3 is maintained.

Preferentially, auxiliary chamber 15 comprises an auxiliary inner space 34 defining a further portion of inner environment 31. Auxiliary inner space 34 is not necessarily a sterile environment.

Preferentially, isolation housing 12 also comprises a containment chamber 35 arranged downstream of auxiliary chamber 15 along tube advancement path Q and being adapted (configured) to receive gas (present within auxiliary chamber 15 itself and) leaking from auxiliary chamber 15.

In particular, containment chamber 35 is connected to, in particular directly connected to, auxiliary chamber 15. In other words, in use, tube 3 advances from auxiliary chamber 15 into containment chamber 35.

In the preferred non-limiting embodiment shown, isolation housing 12 comprises an inlet portion 36 for receiving web 4 and an outlet portion 37 for allowing feeding out of tube 3 from isolation housing 12 itself, in particular into package forming unit 18.

Preferentially, main chamber 14 comprises inlet portion 36.

Preferably, containment chamber 35 defines (comprises) outlet portion 37.

In the preferred non-limiting embodiment shown, sterilization apparatus 7 is coupled to, in particular connected to, main chamber 14, in particular so that web advances from sterilization apparatus 7 into main chamber 14.

Preferably, isolation housing 12 also comprises at least one main separation wall 41 for separating main chamber 14 and auxiliary chamber 15 from one another.

In particular, main separation wall 41 is transversal to axis A. Even more particular, main separation wall 41 has a substantially horizontal orientation.

In particular, main separation wall 41 is interposed between main chamber 14 and auxiliary chamber 15. In other words, main separation wall 41 is arranged in the proximity of a downstream portion (with respect to path Q) of main chamber 14 and in the proximity of an upstream portion (with respect to path Q) of auxiliary chamber 15.

In particular, the portions of tube forming and sealing device 16, which are arranged within main chamber 14, are positioned upstream of main separation wall 41 along path Q.

Figure 3:
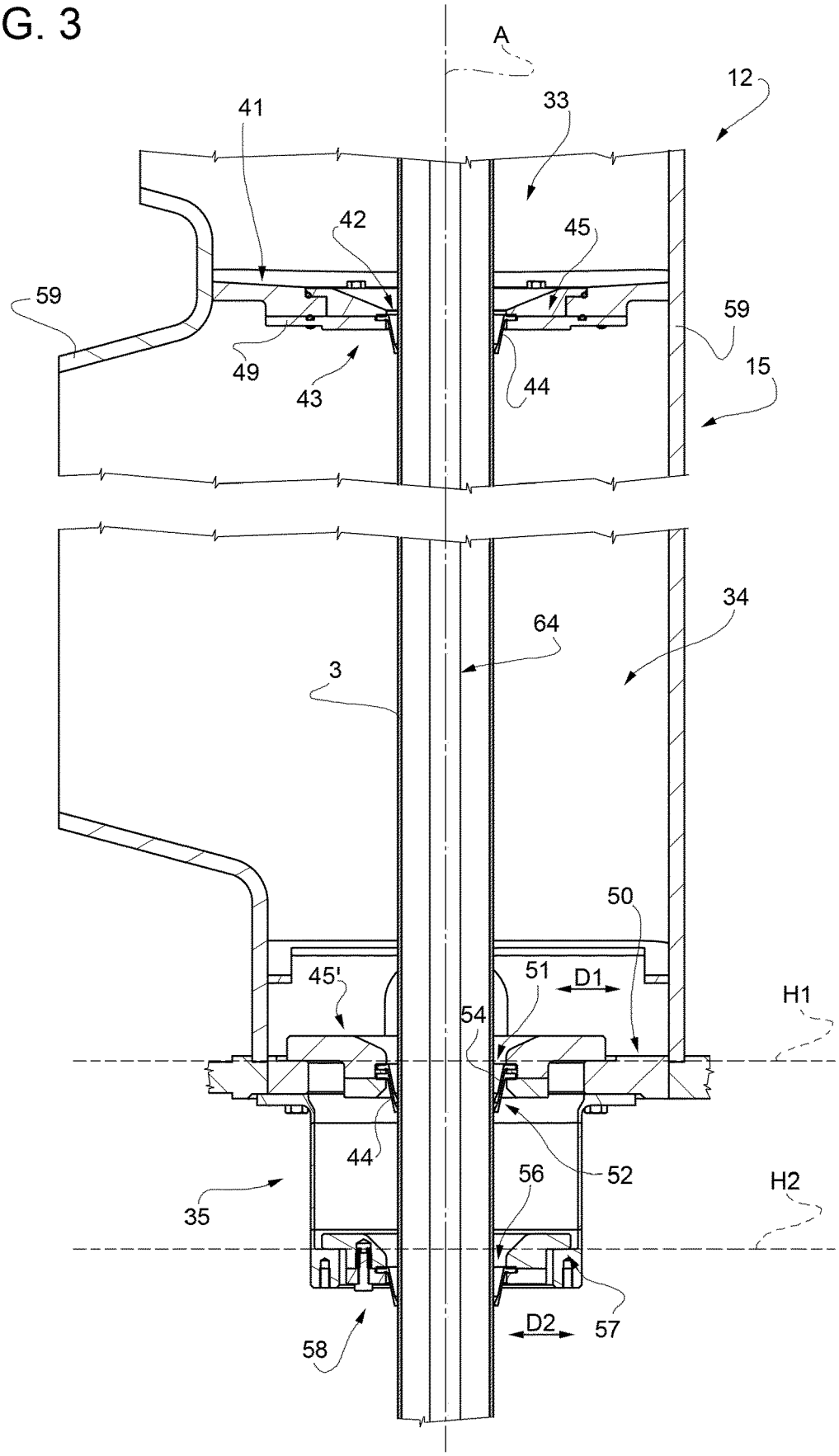
FIG. 3 is a sectionized view of a detail of the packaging machine of FIG. 1, with parts removed for clarity.
Figure 4:
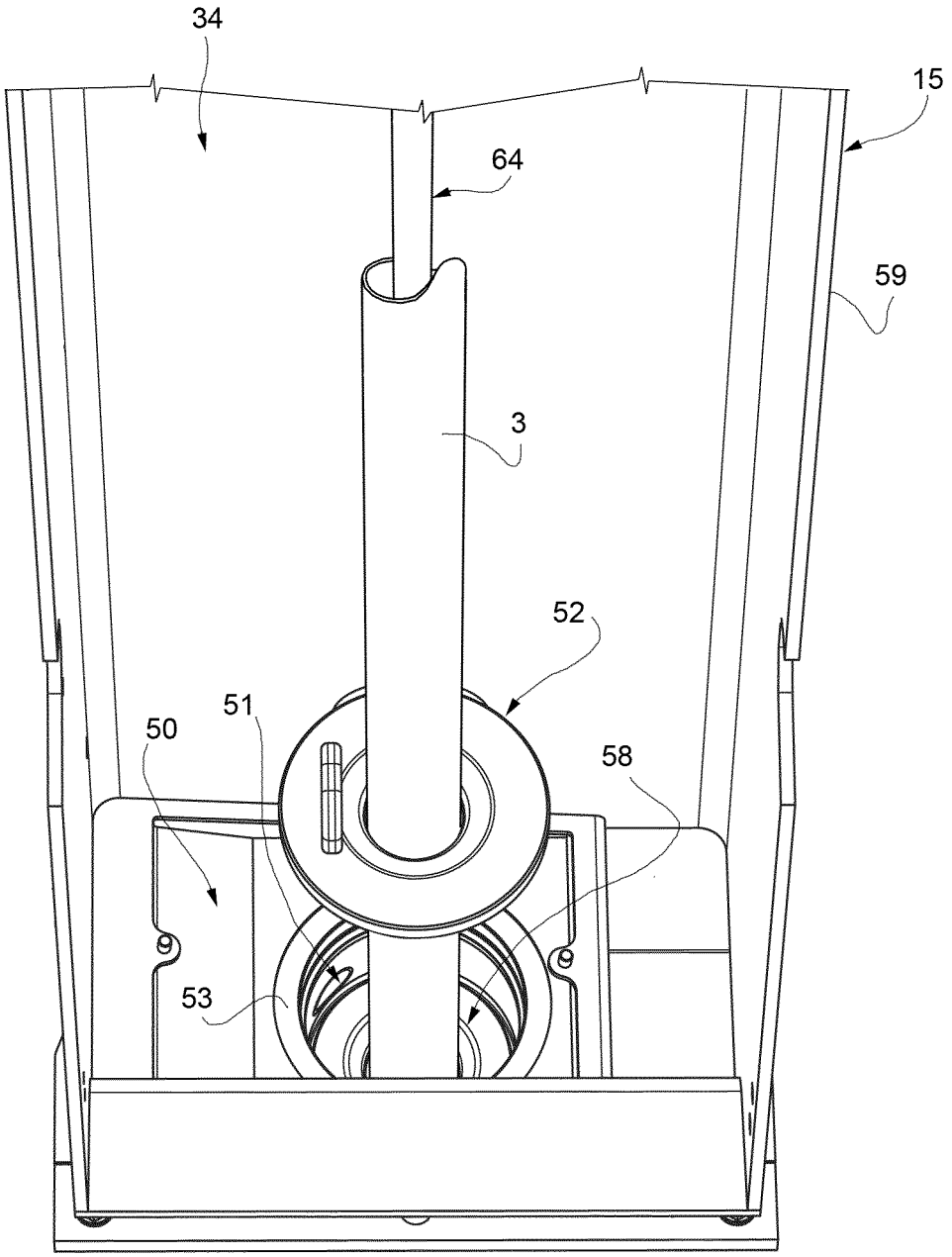
FIG. 4 is a perspective view of a detail of the packaging machine of FIG. 1, with parts removed for clarity.

With particular reference to FIGS. 2 to 4, isolation housing 12, in particular main separation wall 41, comprises a main passage 42, in particular a (circular) hole within main separation wall 41, for allowing the passage of the, in use, advancing tube 3 from main chamber 14 into auxiliary chamber 15.

Preferentially, packaging machine 1, in particular isolation housing 12, comprises at least one main seal assembly 43 being configured to seal, in use, main passage 42, in particular in cooperation with tube 3. In particular, main seal assembly 43 is configured to hinder, in particular to (substantially) impede, an exchange of gas between main chamber 14 and the auxiliary chamber 15 through main passage 42. It must, however, be noted that (non-controllable) leakage flows may still be present between main chamber 14 and auxiliary chamber 15 through main passage 42.

More specifically, main seal assembly 43 is coupled to, in particular at least partially contacting, main separation wall 41 in the area of main passage 42. In particular, main seal assembly 43 is configured to also couple to, even more particular to contact, in use, tube 3.

In other words, main seal assembly 43 is configured to seal main passage 42 in cooperation with main separation wall 41 and tube 3 so as to hinder, in particular to (substantially) impede, a gas exchange between main chamber 14 and auxiliary chamber 15 through main passage 42.

Preferentially, main seal assembly 43 is configured to at least partially guide advancement of tube 3.

Figure 5:
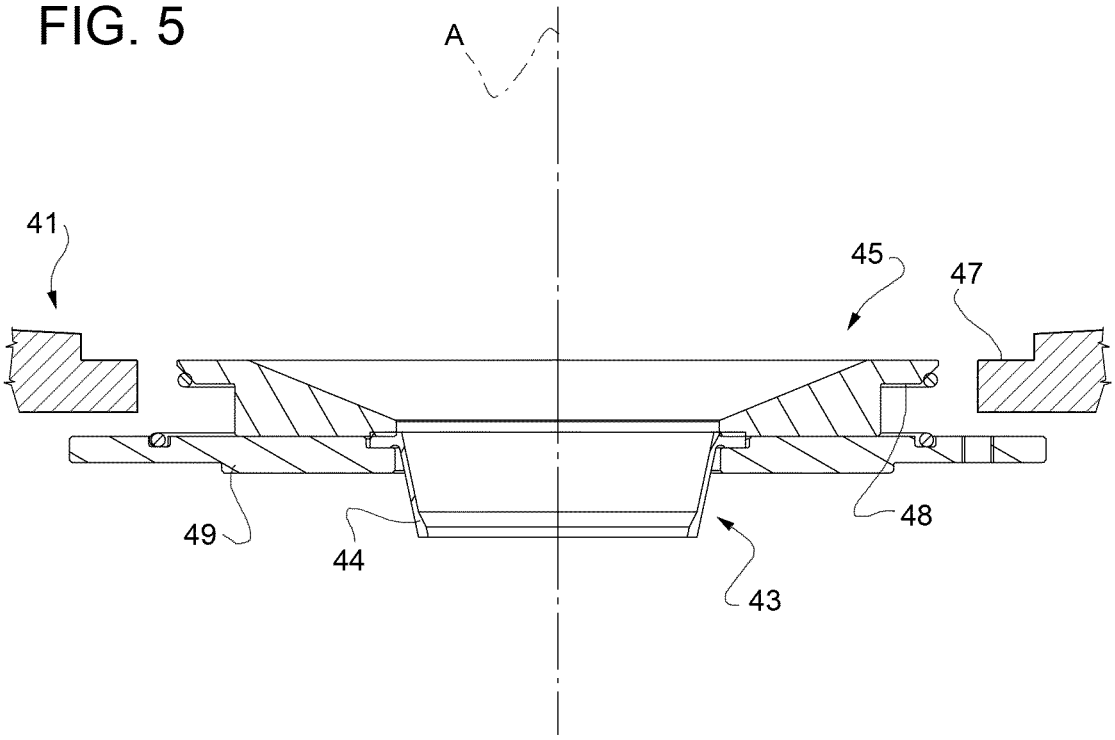
FIG. 5 is a sectionized and partially exploded view of a further detail of the packaging machine of FIG. 1, with parts removed for clarity.
Figure 6:
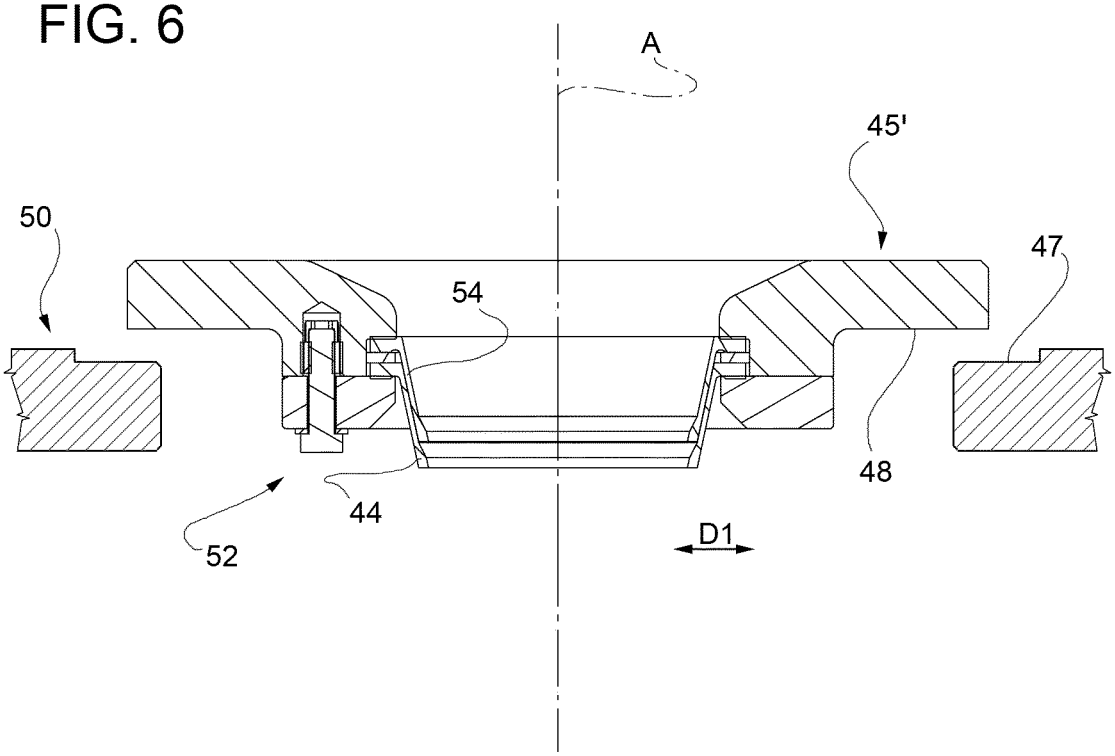
FIG. 6 is a sectionized and partially exploded view of an even further detail of the packaging machine of FIG. 1, with parts removed for clarity.

With particular reference to FIGS. 3 to 5, main seal assembly 43 comprises at least one sealing element, in particular at least one gasket 44 configured to interact with, in particular to contact, the, in use, advancing tube 3 and a carrier structure 45 carrying gasket 44.

Preferentially, carrier structure 45 is configured to be placed or is placed onto main separation wall 41, in particular within main chamber 14. In particular, main seal assembly 43 is configured to seal main passage 42 in cooperation with separation wall 41 and the, in use, advancing tube 3.

More specifically, main passage 42 is sealed by the cooperation of carrier structure 45 with main separation wall 41 and the cooperation of gasket 44 with tube 3.

In more detail, main separation wall 41 comprises an engagement surface 47, in particular surrounding main passage 42, and carrier structure 45 comprises an interaction surface 48, in particular surrounding gasket 44, and being configured to be placed onto engagement surface 47.

In particular, engagement surface 47 is defined by a (annular) recess within main separation wall 41. Preferentially, interaction surface 48 is at least partially complementary to engagement surface 47.

Preferentially, main seal assembly 43 is configured to at least partially guide advancement of tube 3. In particular, main seal assembly 43 is configured to be substantially non-moveable with respect to the, in use, advancing tube 3.

Even more preferentially, carrier structure 45, in particular interaction surface 48, is coupled onto main separation wall 41, in particular engagement surface 47, in a manner that, in use, any movement of main seal assembly 43, in particular carrier structure 45 together with gasket 44, into a direction transversal to axis A is (substantially) impeded.

Preferably, carrier structure 45 also comprises a clamping element 49 configured to clamp a portion of main separation wall 41 between clamping element 49 and interaction surface 48. In this way, it is further ensured that main seal assembly 43 is, in use, non-moveable.

In this way, it is ensured that main seal assembly 43 allows to at least partially guide advancement of tube 3.

With particular reference to FIGS. 2 to 4 and 6, isolation chamber 12 further comprises at least one auxiliary separation wall 50 spaced apart from main separation wall 41 and further delimiting auxiliary chamber 15.

In particular, auxiliary separation wall 50 is transversal to axis A. In particular, auxiliary separation wall 50 has, in particular similar to main separation wall 41, a substantially horizontal orientation.

Even more particular, auxiliary separation wall 50 is arranged downstream of main separation wall 41 along path Q. In particular, auxiliary separation wall 50 and main separation wall 41 delimit auxiliary chamber 15 along axis A.

Preferentially, auxiliary separation wall 50 is arranged in the proximity of a downstream portion (with respect to path Q) of auxiliary chamber 15, in particular defining an end portion of auxiliary chamber 15.

In the specific example embodiment disclosed, main separation wall 41 delimits auxiliary chamber 15 in the area of an upstream portion of auxiliary chamber 15 itself.

In the preferred non-limiting embodiment shown, isolation housing 12, in particular auxiliary separation wall 50, comprises an auxiliary passage 51, in particular a (circular) hole within auxiliary separation wall 50, for allowing the passage of the, in use, advancing tube 3 out of auxiliary chamber 15, and in particular into package forming unit 18, even more particular at first into containment chamber 35 and then into package forming unit 18.

Preferentially, auxiliary passage 51 and main passage 42 are coaxially arranged with respect to one another.

In the preferred non-limiting embodiment disclosed, packaging machine 1, in particular isolation housing 12, comprises an auxiliary seal assembly 52 configured to seal, in use, auxiliary passage 51 for hindering, in particular for (substantially) impeding, a flow of gas into or out of auxiliary chamber 15 through auxiliary passage 51. It must, however, be noted that (non-controllable) leakage flows may still be present through auxiliary passage 51.

In particular, auxiliary seal assembly 52 is coupled to, in particular at least partially contacting, auxiliary separation wall 50 in the area of auxiliary passage 51 for sealing, in use, auxiliary passage 51. In particular, auxiliary seal assembly 52 is configured to also couple to, even more particular to contact, in use, tube 3.

In other words, auxiliary seal assembly 52 is configured to seal auxiliary passage 51 in cooperation with auxiliary separation wall 50 and the, in use, advancing tube 3 so as to at least hinder, in particular to (substantially) impede, a gas outflow from and/or a gas inflow into auxiliary chamber 15 through auxiliary passage 51. In particular, by providing for auxiliary seal assembly 52 a (substantial) gas exchange between auxiliary chamber 15 and containment chamber 35 through auxiliary passage 51 is hindered, in particular impeded.

Auxiliary seal assembly 52 is similar to main seal assembly 43, which is why in the following auxiliary seal assembly 52 is only described with respect to the differences to main seal assembly 43, using the same references for similar or equivalent parts.

In particular, auxiliary seal assembly 52 differs from main seal assembly 43 in that at least a portion of auxiliary seal assembly 52 is moveable into a direction D1 transversal, in particular perpendicular, to longitudinal axis A as a result of the interaction with the, in use, advancing tube 3.

Even more particular, auxiliary seal assembly 52 is configured to be moveable within a plane H1 transversal, in particular perpendicular, to longitudinal axis A. In particular, in use, auxiliary seal assembly 52 moves within plane H1 as a result of the interaction with the, in use, advancing tube 3.

More specifically, plane H1 is substantially defined by the respective engagement surface 47 and the respective interaction surface 48.

Preferably, the respective carrier structure 45' (which is substantially similar to carrier structure 45) of auxiliary seal assembly 52 is coupled to auxiliary separation wall 50 in the area of auxiliary passage 51 in a floating manner.

Even more preferably, the respective carrier structure 45' of auxiliary seal assembly 52, in particular the respective carrier structure 45' together with at least gasket 44, is configured to move, in use, into direction D1, in particular within plane H1, in particular as a result of the interaction with the, in use, advancing tube 3. In particular, it is known that, in use, tube 3 may present fluctuations, i.e. movements into a respective direction transversal, in particular orthogonal, to axis A (or, in other words, the portion of path Q while tube 3 advances within auxiliary chamber 15) and as a result of the interaction of, in particular the contact between, auxiliary seal assembly 52, in particular at least gasket and tube 3 the fluctuations are transferred to auxiliary seal assembly 52, in particular carrier structure 45'.

In this way, auxiliary seal assembly 52 is configured to avoid, in use, any guidance and constraint of the advancing tube 3. In even other words, auxiliary seal assembly 52, in particular the respective carrier structure 45', is configured to move, in use, into direction D1, in particular within plane H1, transversal, preferentially perpendicular, to the, in use, advancing tube 3.

In more detail, auxiliary separation wall 50 comprises an engagement surface 53, in particular surrounding auxiliary passage 51. Preferentially, engagement surface 53 is defined by a (annular) recess within auxiliary separation wall 50.

Preferentially, carrier structure 45', in particular the respective interaction surface 48 of the respective carrier structure 45', is moveably placed or placeable onto engagement surface 53, in particular so that the respective carrier structure 45' is moveable along direction D1, in particular within plane H1. In particular, carrier structure 45' even more particular the respective interaction surface 48, is moveable on and with respect to engagement surface 53.

In the example embodiment shown, the respective cross-sectional dimension of the respective interaction surface 48 is minor than the respective cross-sectional dimension of the recess defining engagement surface 53.

In other words, auxiliary seal assembly 52, in particular the respective carrier structure 45', even more particular the respective interaction surface 48, is coupled to auxiliary separation wall 50 in the area of the auxiliary passage 51, in particular engagement surface 53, even more particular the recess defining engagement surface 53, with play, in particular along direction D1, even more particular within plane H1.

In a preferred, non-limiting embodiment, interaction surface 48 of carrier structure 45' is a smoothened surface allowing for a reduced friction between engagement surface 53 and interaction surface 48 itself.

Auxiliary seal assembly 52 also differs from main separation wall 41 in that auxiliary seal assembly 52 preferably also comprises a second sealing element, in particular a second gasket 54 coaxially arranged with respect to the respective gasket 44, and configured to also contact, in use, the advancing tube 3.

In an alternative embodiment, auxiliary seal assembly 52 comprises only gasket 44.

In an even alternative embodiment, auxiliary seal assembly 52 comprises a plurality of gaskets, in particular having more than two gaskets.

With particular reference to FIGS. 2 and 3, containment chamber 35 comprises an outlet passage 56, in particular coaxial to auxiliary passage 51, configured to allow tube 3 to exit from containment chamber 35, in particular into package forming unit 18.

In particular, containment chamber 35 comprises an end wall 57 having outlet passage 56, and in particular being transversal to axis A. Preferentially, end wall 57 has a substantially horizontal orientation.

Preferentially, outlet passage 56 is defined by a (circular) hole provided within end wall 57.

Preferentially, isolation chamber 12, in particular containment chamber 35, comprises a final seal assembly configured to seal, in use, outlet passage 56, in particular in cooperation with tube 3 for at least hindering, in particular (substantially) impeding a flow of gas out from or into containment chamber 35 through outlet passage 56. However, a (non-controllable) leakage flow or (non-controllable) leakage flows through outlet passage 56 may still be present.

Preferentially, final seal assembly 58 is coupled to, in particular contacts, end wall 57 in the area of outlet passage 56 and is configured to couple to, even more particular to contact, in use, tube 3. In particular, final seal assembly 58 is configured to seal outlet passage 56 in cooperation with end wall 57 and the, in use, advancing tube 3.

Final seal assembly 58 is similar to auxiliary seal assembly 52, which is why in the following final seal assembly 58 is only described with respect to the differences to auxiliary seal assembly 52, using the same references for similar or equivalent parts.

In particular, final seal assembly 58 comprises only gasket 44. However, in an alternative embodiment, final seal assembly 58 could also comprise one or more further sealing elements (gaskets).

Furthermore, outlet passage 56 is similar to auxiliary passage 51, which is why in the following outlet passage 56 is only described with respect to the differences to auxiliary passage 51, using the same references for similar or equivalent parts.

In particular, the difference is that outlet passage 56 is comprised in end wall 57.

It must be stressed that similar to auxiliary seal assembly 52 final seal assembly 58 is configured to move along a direction D2, in particular being parallel to direction D1, transversal, in particular perpendicular to, axis A. In particular, final seal assembly 58 is configured to move within a plane H2 transversal, in particular perpendicular, to axis A. Similar to auxiliary seal assembly 52 final seal assembly 58 is configured to move, in use, into direction D2, in particular within plane H2, as a result of the interaction, in particular the contact with, the, in use, advancing tube 3. In particular, plane H2 is spaced apart and parallel to plane H1.

Preferentially but not necessarily, plane H2 is substantially defined by the respective engagement surface 47 and the respective interaction surface 48.

In particular, the respective carrier structure 45' of final seal assembly 58 is coupled to end wall 57 in a floating manner. In particular, the respective carrier structure 45', even more particular the respective interaction surface 48, of final seal assembly 58 is moveable on and with respect to the respective engagement surface 53.

In the preferred embodiment disclosed, isolation housing 12 also comprises a plurality of lateral walls 59 for further delimiting inner environment 31. In particular, lateral walls 59 substantially extend parallel to axis A; i.e. preferably having a vertical orientation.

With particular reference to FIG. 1, tube forming and sealing device 16 comprises at least a tube forming group 61 configured to form tube 3 from web 4 and at least a sealing head 62 configured to longitudinally seal tube 3, in particular being arranged within main chamber 14.

More specifically, tube forming group 61 and sealing head 63 are arranged within main chamber 14.

In more detail, tube forming group 61 comprises at least a plurality of forming ring assemblies 63, in the particular example shown in FIG. 1 two forming ring assemblies 63, arranged within main chamber 14 and being adapted to fold web 4 gradually into tube 3, in particular by overlapping the respective lateral edges of web 4. In particular, forming ring assemblies 63 are arranged within parallel and spaced apart planes, in particular being orthogonal to axis A, even more specifically having a substantially horizontal orientation. Preferably, the forming ring assembly 63 arranged downstream of the other one is designed to also exert a mechanical force on tube 3, in particular for promoting the longitudinal sealing of tube 3.

With particular reference to FIGS. 1 and 2, filling device 17 comprises at least a filling tube 64 being in fluid connection with a pourable product storage tank (not shown and known as such) and being partially placed within tube 3 for feeding the pourable product into tube 3.

In more detail, filling tube 64 has a L-shaped configuration arranged in such a manner that a linear main tube portion 65 of filling tube 64 extends parallel to axis A and within tube 3. In particular, filling tube 64 also comprises a curved portion 66 being connected to linear main tube portion 65 and being arranged within main chamber 14.

In even more detail, linear main tube portion 65 is provided with portions extending respectively within main chamber 14 and auxiliary chamber 15, preferentially also within containment chamber 35, even more preferentially also within package forming unit 18.

In a preferred non-limiting embodiment, linear main tube portion 65 comprises at least one upstream section and at least one downstream section 68 carrying an outlet mouth from which, in use, the pourable product exits into tube 3, upstream section 67 and downstream section 68 being connected to one another. In particular, upstream section 67 is also connected to curved portion 66.

More specifically, upstream section 67 extends within main chamber 14 and into auxiliary chamber 15 and, preferably, downstream section 68 extends within auxiliary chamber 15 into package forming unit 18, in particular through containment chamber 35.

Preferentially, the junction between upstream section 67 and downstream section 68 is in the area of main passage 42.

With particular reference to FIG. 2, package forming unit 18 comprises a plurality of complementary pairs of operative units 69 (only one pair shown) configured to at least shape and transversally seal, in particular also to transversally cut, packages 2.

Advantageously, pressure control device 25 is adapted to (configured to) control at least a first pressure within main chamber 14 and at least a second pressure within auxiliary chamber 15.

In particular, the first pressure is higher than the second pressure and the first pressure and the second pressure are both higher than the ambient pressure.

In particular, in this way pressure control device 25 is configured to control the first pressure and the second pressure such that contaminations are prevented to enter from outer environment 32 and/or auxiliary chamber 15 into main chamber 14.

In a preferred non-limiting embodiment, pressure control device 25 is configured to control the first pressure to range between 200 Pa to 10000 Pa (2 mbar to 100 mbar) above ambient pressure, preferentially 500 Pa to 9000 Pa (5 mbar to 90 mbar) above ambient pressure, even more preferentially 800 Pa to 8000 Pa (8 mbar to 80 mbar) above ambient pressure.

In particular, pressure control device 25 is configured to control the first pressure and the second pressure such that the pressure difference between the first pressure and second pressure ranges between 500 Pa to 2500 Pa (5 mbar to 25 mbar), in particular between 800 Pa to 1200 Pa (8 mbar to 12 mbar). Even more particular, pressure control device 25 is also configured to control the first pressure to be higher than 500 Pa, preferably higher than 800 Pa, above ambient pressure.

More specifically, pressure control device 25 comprises:

- a gas conditioning unit 73 configured to direct a pressurized (sterile) gas into main chamber 14 for controlling the first pressure; and
- a flow conduct 74 fluidically connecting main chamber 14 with auxiliary chamber 15 and configured to allow a (controlled) flow of gas from main chamber 14 into auxiliary chamber 15, in particular for controlling the second pressure.

Even more specifically, gas conditioning unit 73 comprises an injection tube 75 at least partially arranged within main chamber 14 and configured to inject the (sterile) gas into main chamber 14 and, preferably also a control valve 76 for controlling the flow of gas within injection tube 75.

More specifically, injection tube 75 extends at least partially within main chamber 14 parallel to axis A and comprises a plurality of nozzles for injecting the pressurized gas into main chamber 14.

In a preferred non-limiting embodiment, gas conditioning unit 73 is further configured to at least pressurize the gas, even more preferentially to pressurize and sterilize the gas, in particular at least prior to its injection into main chamber 14.

In a preferred non-limiting embodiment, gas conditioning unit 73 also comprises a further injection tube 77 configured to inject the pressurized (sterile) gas into sterilization apparatus 7, in particular into shielding chamber 27. Preferentially, injection tube 77 is configured to inject the gas in the area of an interface between sterilization apparatus 7 and isolation housing 12.

In a preferred non-limiting embodiment, pressure control device 25 also comprises a control valve 78, preferably a ball valve, arranged within flow conduct 74 and being configured to control the flow of gas from main chamber 14 to auxiliary chamber 15 through flow conduct 74, in particular for controlling the second pressure.

Advantageously but not necessarily, pressure control device 25 further comprises a measuring unit 79 configured to measure and/or determine the first pressure (the pressure within main chamber 14).

Preferably, pressure control device 25 is configured to control control valve 76 in function of the first pressure as measured and/or determined by measuring unit 79, in particular for controlling that the first pressure to range between 200 Pa to 10000 Pa above ambient pressure, preferentially 500 Pa to 9000 Pa above ambient pressure, even more preferentially 800 Pa to 8000 Pa above ambient pressure.

In a preferred non-limiting embodiment, auxiliary chamber 15 comprises an outlet orifice 80 configured to allow gas to exit from auxiliary chamber 15 itself.

In a preferred non-limiting embodiment, pressure control device 25, in particular gas conditioning unit 73, comprises a recovery circuit (only partially shown) configured to at least receive gas from auxiliary chamber 15, in particular, through outlet orifice 80. In particular, the recovery circuit is also configured to recirculate at least a portion of the gas exiting from auxiliary chamber 15, in particular through outlet orifice 80. In other words, the recovery circuit is preferentially also configured to allow to collect the gas in a controlled manner and to redirect at least a portion of the gas, after reconditioning of the portion of the gas (i.e. pressurization and, in particular sterilization), into main chamber 14.

More specifically, the recovery circuit comprises a collection conduct 81 fluidically connected to auxiliary chamber 15, in particular through outlet orifice 80, for receiving the gas from auxiliary chamber 15.

In a preferred non-limiting embodiment, outlet orifice 80 and/or the recovery circuit are configured to allow for a constant flow of gas out of auxiliary chamber 15.

Advantageously but not necessarily, pressure control device 25 also comprises a gas inlet assembly 82 configured to control the introduction of new gas, in particular originating from outer environment 32, into gas conditioning unit 73. In particular, by providing for gas inlet assembly 82 it is possible to compensate for any possibly occurring of losses of gas out of isolation housing 12 and gas conditioning unit 73, in particular into outer environment 32.

More specifically, gas inlet assembly 82 is in fluid connection with containment chamber 35 and is configured to aspirate new gas through containment chamber 35.

Even more specifically, gas inlet assembly 82 comprises an inlet orifice 83 provided with (comprised by) containment chamber 35 for allowing at least inlet of new gas from outer environment 32 into containment chamber 35 and, in particular also a valve member (not shown) for selectively opening or closing a fluid connection between outer environment 32 and containment chamber 35 through inlet orifice 83. In particular, gas inlet assembly 82 also comprises a through-orifice 84 (provided with (comprised by) containment chamber 35) and a gas conduct 85 for fluidically connecting containment chamber 35 and gas conditioning unit 73 for directing gas from containment chamber 35 into gas conditioning unit 73.

In a preferred non-limiting embodiment, the valve member is controlled such to guarantee that the pressure within containment chamber 35 is about the ambient pressure. It is to be noted that gas being present in auxiliary chamber 15 may also (in a non-controlled manner) leak into containment chamber 35 through auxiliary passage 51.

In a preferred non-limiting embodiment, pressure control device 25, in particular gas conditioning unit 73, is configured to aspirate gas from sterilization apparatus 7, in particular shielding chamber 27, and to direct it to gas conditioning unit 73 itself, in particular for purposes of recirculation.

Preferably, pressure control device 25, in particular gas conditioning unit 73, comprises a connection conduct 86 fluidically connected to sterilization apparatus 7, in particular shielding chamber 27, and a flow control valve 87 for controlling the flow of gas from sterilization apparatus 7, in particular shielding chamber 27, to gas conditioning unit 73.

In use, packaging machine 1 forms packages 2 filled with the pourable product.

In more detail, a method of forming packages 2 comprises the following steps:

advancing web 4 along advancement path P;

folding web 4 within a main chamber 14 of an isolation housing 12 into tube 3 at tube forming station 18;

longitudinally sealing tube 3 within main chamber 14;

filling tube 3 with the pourable product;

advancing tube 3 along path Q through a portion of main chamber 14 and into and through an auxiliary chamber 15; and obtaining single packages 2 from tube 3 by forming tube 3, transversally sealing tube 3 between successive packages 2 and, in particular transversally cutting tube between successive packages 2 for obtaining single packages 2.

Advantageously, the method also comprises a step of controlling the pressure, during which the first pressure within main chamber 14 and the second pressure within auxiliary chamber 15 are controlled such that the first pressure is higher than the second pressure and the second pressure is higher than the ambient pressure.

In a preferred non-limiting embodiment, the method also comprises the step of sterilizing at least the first face, in particular also the second face, of web 4 at sterilization station 8. In particular, the step of sterilizing is executed before the step of folding web 4.

During the step of folding tube 3, tube forming and sealing device 16 gradually overlaps the opposite lateral edges of web 4 with one another so as to form a longitudinal seal.

During the step of longitudinally sealing tube 3, tube forming and sealing device 16 seals the overlapped opposite lateral edges of web 4 to obtain the longitudinal seal.

During the step of advancing tube 3, conveying means 5 advance tube 3 (and any intermediates of tube 3) along path Q to package forming unit 18.

In particular, conveying means 5 advance tube 3 through a portion of main chamber 14, to and through auxiliary chamber 15, and in particular to and through containment chamber 35.

During the step of filling tube 3, filling device 17 fills the pourable product into the longitudinally sealed tube 3.

During the step of obtaining single packages 2, package forming unit 18 forms and transversally seals tube 3 between successive packages 2 and, preferentially, also transversally cuts tube 3 between successive packages 2.

In more detail, during the step of sterilizing web 4, at least a sub-step of directing a sterilizing irradiation, in particular electromagnetic irradiation, even more particular electron beam irradiation, onto at least the first face, preferentially also onto the second face, of web 4 is executed.

In more detail, during the step of controlling the pressure, the first pressure is controlled to range between 200 Pa to 10000 Pa above ambient pressure, preferentially 500 Pa to 9000 Pa above ambient pressure, even more preferentially 800 Pa to 8000 Pa above ambient pressure.

In a preferred non-limiting embodiment 15, during the step of controlling the pressure, the first pressure and the second pressure are controlled such that the pressure difference between the first pressure and second pressure ranges between 500 Pa to 2500 Pa, in particular between 800 Pa to 1200 Pa. In particular, the first pressure is controlled such that it is higher than 500 Pa, preferably higher than 800 Pa, above ambient pressure.

More specifically, during the step of controlling the pressure, a pressurized (sterile) gas is fed into main chamber 14. In particular, the pressurized gas enters main chamber 14 through injection tube 75.

In a preferred non-limiting embodiment, during the step of controlling the pressure, the pressurized (and sterilized) gas is generated by gas conditioning unit 73.

Preferably, during the step of controlling the pressure, the pressurized gas is fed from main chamber 14 into auxiliary chamber 15 through flow conduct 74, in particular the flow of gas through flow conduct 74 being controlled by means of control valve 78 for controlling the second pressure.

In a preferred non-limiting embodiment, the first pressure within main chamber 14 is measured and/or determined, in particular for controlling control valve 76.

In a preferred non-limiting embodiment, the step of controlling the pressure also comprises a sub-step of recirculation, during which gas is extracted from auxiliary chamber 15 and at least a portion of the extracted gas is reconditioned (pressurized and, in particular also sterilized) for being newly injected into main chamber 14. In particular, during the reconditioning, the extracted gas is sterilized and is newly pressurized.

In a preferred non-limiting embodiment, the step of controlling the pressure further comprises a sub-step of introducing, during which new gas, in particular originating from outer environment 32, is introduced into gas conditioning unit 73.

In particular, the new gas is introduced into containment chamber 35, in particular through inlet orifice 83 and is directed, in particular through through-orifice 84 and gas conduct 85, from containment chamber 35 to gas conditioning unit 73.

The advantages of packaging machine 1 according to the present invention will be clear from the foregoing description.

In particular, by having pressure control device 25 controlling the first pressure within main chamber 14 and the second pressure within auxiliary chamber 15 it is possible to reduce the mechanical stress on the longitudinal seal while the latter is still warm and relatively weak.

Another advantage, due to the increased stability of the longitudinal seal, lies in the possibility to further increase the processing speed of packaging machine 1.

An even other advantage is that by controlling the pressure within main chamber 14 it is possible to also control the pressure within tube 3, which allows to further improve control of the overall forming process, in particular at high processing speeds. As also auxiliary chamber 15 is pressurized with respect to the ambient pressure the pressure acting on the longitudinal seal is reduced with respect to a packaging machine which does not allow for increasing the pressure within the auxiliary chamber above ambient pressure.

An even further advantage is that the stability of tube 3 has been increased with respect to the stability of tubes within state-of-the-art packaging machines 1.

Clearly, changes may be made to packaging machine 1 as described herein without, however, departing from the scope of protection as defined in the accompanying claims.

In an alternative embodiment not shown, main seal assembly 43 may be coupled to main separation wall 41 in a floating manner. In such an alternative configuration, main seal assembly 43 may have a design similar to the one of auxiliary seal assembly 52. Preferably, in such an alternative embodiment, also engagement surface 47 would be formed to allow for a movement of the respective carrier structure 45 along a direction transversal to axis A.

The invention claimed is:

1. A packaging machine for producing sealed packages of a pourable product from a web of packaging material advancing along a web advancement path, the packaging machine comprising:

a conveyor for advancing the web of packaging material along the web advancement path at least to a tube forming station at which the web of packaging material is formed, in use, into a tube and for advancing the tube along a tube advancement path;

an isolation housing having a main chamber and an auxiliary chamber arranged downstream of the main chamber along the tube advancement path;

a tube forming and sealing device at least partially arranged within the main chamber and being configured to form and longitudinally seal the tube, in use, within the main chamber;

a filling device for filling the tube with the pourable product; and a pressure control device configured to control a first pressure within the main chamber and a second pressure within the auxiliary chamber such that the first pressure is higher than the second pressure and the first pressure and the second pressure are both higher than the ambient pressure.

2. The packaging machine according to claim 1, wherein the pressure control device is configured to control the first pressure to range between 200 Pa to 10000 Pa above ambient pressure.

3. The packaging machine according to claim 1, wherein the pressure control device is configured to control the first pressure and the second pressure such that the pressure difference between the first pressure and the second pressure ranges between 500 Pa to 2500 Pa.

4. The packaging machine according to claim 1, wherein the pressure control device comprises:

a gas conditioning unit for introducing a pressurized gas into the main chamber for controlling the first pressure; and a flow conduct fluidically connecting the main chamber with the auxiliary chamber and configured to allow a flow of gas from the main chamber into the auxiliary chamber.

5. The packaging machine according to claim 4, and further comprising a valve arranged within the flow conduct and configured to control the flow of gas from the main chamber to the auxiliary chamber through the flow conduct for controlling the second pressure.

6. The packaging machine according claim 1, wherein the pressure control device comprises a measuring unit configured to measure and/or determine the first pressure within the main chamber.

7. The packaging machine according claim 1, wherein the isolation housing comprises at least one main passage for allowing, in use, the passage of the tube from the main chamber into the auxiliary chamber; and wherein the packaging machine further comprises at least one main seal assembly being configured to seal, in use, the main passage.

8. The packaging machine according to claim 7, wherein the isolation housing further comprises at least one auxiliary passage for allowing the passage of the tube out of the auxiliary chamber; and wherein the packaging machine further comprises at least an auxiliary seal assembly configured to seal, in use, the auxiliary passage.

9. The packaging machine according to claim 8, wherein the isolation housing extends along a longitudinal axis; and wherein at least a portion of the auxiliary seal assembly is configured to move within a plane transversal to the longitudinal axis as a result of an interaction with the, in use, advancing tube.

10. The packaging machine according to claim 1, wherein the pressure control device comprises a recovery circuit having a collection conduct connected to the auxiliary chamber and being configured to receive gas from the auxiliary chamber and to recirculate at least a portion of the gas, in particular after reconditioning of the portion of gas, back into the main chamber.

11. The packaging machine according claim 1, wherein the isolation housing comprises a containment chamber arranged downstream of the auxiliary chamber along the tube advancement path and being adapted to receive gas leaking from the auxiliary chamber.

12. A method for producing sealed packages of a pourable product comprising the steps of:

advancing a web of packaging material along a web advancement path at least to a tube forming station; and folding the web of packaging material within a main chamber of an isolation housing into a tube at the tube forming station;

longitudinally sealing the tube within the main chamber;

advancing the tube along a tube advancement path through a portion of the main chamber and into and through an auxiliary chamber of the isolation housing arranged downstream of the main chamber along the tube advancement path; and filling the formed tube with the pourable product; and controlling the pressure, during the step of controlling the pressure a first pressure is controlled within the main chamber and a second pressure is controlled within the auxiliary chamber such that the first pressure is higher than the second pressure and the second pressure is higher than the ambient pressure.

13. The method according to claim 12, wherein during the step of controlling the pressure, the first pressure is controlled to range between 200 Pa to 10000 Pa above ambient pressure.

14. The method according to claim 12, wherein during the step of controlling the pressure, the first pressure is controlled to be at least higher than 500 Pa above ambient pressure and the pressure difference between the first pressure and the second pressure is controlled to range between 500 Pa to 2500 Pa.

15. The method according to claim 12, wherein during the step of controlling the pressure, a pressurized gas is fed into the main chamber and the pressurized gas is fed through a flow conduct from the main chamber into the auxiliary chamber; the flow of gas through the flow conduct being controlled at least by a control valve arranged within the flow conduct.

* * * * *